US006998607B1

(12) United States Patent
Davis et al.

(10) Patent No.: US 6,998,607 B1
(45) Date of Patent: Feb. 14, 2006

(54) TEMPERATURE COMPENSATED TIME-OF-FLIGHT MASS SPECTROMETER

(75) Inventors: Stephen C. Davis, Ascot (AU); Lee Earley, Mountain View, CA (US); Mark Hardman, Sunnyvale, CA (US); Adrian Land, San Carlos, CA (US); Gershon Perelman, Cupertino, CA (US)

(73) Assignee: Thermo Finnigan LLC, San Jose, CA (US)

( * ) Notice: Subject to any disclaimer, the term of this patent is extended or adjusted under 35 U.S.C. 154(b) by 15 days.

(21) Appl. No.: 10/931,809

(22) Filed: Aug. 31, 2004

(51) Int. Cl.
*H01J 49/40* (2006.01)

(52) U.S. Cl. ..... 250/287

(58) Field of Classification Search ..... None
See application file for complete search history.

(56) References Cited

U.S. PATENT DOCUMENTS 6,049,077 A 4/2000 Franzen
6,465,777 B1 10/2002 Rache
6,498,891 B1 * 12/2002 Montesanto et al. ..... 385/134
2003/0012499 A1 1/2003 Mendez et al.
2003/0034448 A1 2/2003 Yefchak et al.
2005/0023454 A1 * 2/2005 Bateman et al. ..... 250/288

FOREIGN PATENT DOCUMENTS

GB 2329066 A 3/1999

* cited by examiner

*Primary Examiner*—Jack I. Berman
(74) *Attorney, Agent, or Firm*—Sharon Upham

(57) ABSTRACT

An apparatus that comprises material which have different thermal expansion coefficients, combined in such a way that the length of the drift region is variant, and self adjusting with temperature. The adjustment is such as to compensate for the length changes resulting from thermal expansion or contraction in other ion optical elements, such that ions of substantially equivalent mass to charge ratios maintain a constant flight time though the system. This allows for use of standard construction methods for the ion optical elements.

23 Claims, 3 Drawing Sheets

TEMPERATURE COMPENSATED TIME-OF-FLIGHT MASS SPECTROMETER

BRIEF DESCRIPTION OF THE INVENTION

The invention relates to time-of-flight mass spectrometers and more particularly to a method and apparatus for compensating for temperature variations in the mass spectrometer.

BACKGROUND OF THE INVENTION

Time-of-flight mass spectrometry (TOFMS) is based upon the principle that ions of different mass to charge ratios travel at different velocities such that a packet of ions accelerated to a specific kinetic energy separates out over a defined distance according to the mass to charge ratio. By detecting the time of arrival of ions at the end of the defined distance, a mass spectrum can be built up.

Orthogonal TOFMSs operate in so-called cyclic mode, in which successive packets of ions are accelerated to a kinetic energy, separated in flight according to their mass to charge ratios, and then detected. The complete time spectrum in each cycle is detected and the results added to a histogram.

It has been observed that ions of a particular mass to charge ratio typically reach the detector with a range of arrival times. The range of arrival times can be due to effects of location in the extraction field at the output of the ion source, and the initial kinetic energy, which ultimately results in reduced resolution.

To maintain high mass accuracy in a TOFMS, high stability of the calibration of the mass spectrometer must be maintained. This means that the flight time for ions of substantially the same mass must be substantially constant over time. The flight time for ions of substantially the same mass can be influenced by temperature. The materials from which the optical elements of the instrument are constructed will undergo thermal expansion or thermal contraction as the temperature varies. Thermal expansion or contraction can affect both the lengths and electric field gradients which in turn affect the flight times of ions through the mass spectrometer.

The calibration function of a TOFMS is approximately a linear relationship between the ion mass and the square of the ion flight time. For accurate results the calibration may be slightly non-linear to account for subtle differences in initial starting positions and energies (hence resulting in a calibration curve). The two main factors that affect the stability of the calibration curve, and hence the constancy of flight times, are firstly the drift in the voltages applied to the ion-optical elements and secondly the thermal expansion or contraction effect within the construction materials of the elements defining the flight path of the ions.

Drift in voltage supplies that are applied to the ion-optical elements are largely due to thermal effects, and to minimize this, the voltage providing power supplies can be housed in a thermally stabilized environment.

Providing compensation for the thermal drift (thermal expansion or contraction) of the construction materials of the elements defining the flight path of the ions is a focus of the invention.

One method of dealing with the thermal drift described above is to use internal standards. An internal standard is a compound of known mass which is analyzed together with the sample under analysis. The deviation of the measured mass of the internal standard to the known mass of the internal standard can be employed to correct the calibration curve and restore the correct value for the standard. In order to best account for non-linear affects of internal standard, the internal standard is added to the sample under analysis, so that it is subjected to the same ionisation and instrumental conditions. The disadvantage of this is that there may be interference of the standard in the mass spectrum when unknown samples are being analyzed, and there is competition for ionization with the sample molecules, unless ionized in a separate source. When obtaining a mass spectrum over a broad range of masses, it is beneficial to use internal standards that are close in mass to the masses of interest to account for non-linearity in the calibration curve.

Another method of dealing with the thermal drift of the construction materials is to compensate for the thermal expansion effects. The temperature of the elements in the flight path can be measured, for example with thermocouples, and a correction made to the calibration curve based on the changes measured. These methods typically require very accurate measurement of the temperature, and that adds additional costs and complexity in the control system and software required.

Yet another method of dealing with the thermal drift of the construction materials is to control the spacing between the ion elements and the optical elements via an external control mechanism such that the flight time does not vary with temperature. Once again, this adds additional costs and complexity to the instrument.

Another solution is to control the spacing between the ion elements and the optical elements via internal control mechanisms (such an inherent properties of the construction materials) such that the flight time does not vary with temperature. One can use construction materials with negligible thermal expansion coefficients. However it is not currently practical to build an entire structure out of such materials. A compromise is to build combinations of construction material with different thermal expansion coefficients, such that the effects of their thermal expansions compensate for each other, and the lengths of the various ion and/or optical elements remain constant, but this can mean complex construction.

A further method of dealing with the thermal drift of the construction materials is to enclose the entire instrument in a temperature controlled environment to maintain an accurate constant temperature. Since most TOFMSs are relatively large instruments, implementation of this method adds considerably cost to the instrument.

There is a need for a solution to thermal compensation for elements of a TOFMS such that the desired level of mass accuracy can be achieved.

SUMMARY OF THE INVENTION

In general, the invention provides apparatus and methods for compensating for temperature variations in a time-of-flight mass spectrometer. The time-of-flight mass spectrometer comprises material that have different thermal expansion coefficients, the materials being combined in such a way that the length of the ion drift region is variant, and self adjusting with temperature. The adjustment is such as to compensate for the length changes resulting from thermal expansion or contraction in the ion optical elements, such that ions of substantially equivalent mass to charge ratios maintain a constant flight time from one location to another through the system. This allows for use of standard construction methods for the ion optical elements.

In one aspect of the invention, the invention is directed to a time-of-flight mass spectrometer having a time-of-flight chamber and comprising: at least a first element having a temperature-dependent parameter that causes a time-of-flight of ions along a first segment of a flight path to change with a change in temperature, the flight path extending between a first and a second location; a spacer having a temperature-dependent dimension, the dimension determining a position of a second element, the position influencing the time-of-flight of ions along a second segment of the flight path of ions within the chamber; wherein the material and size of the spacer is selected such that during operation of the mass spectrometer, the aggregate time it takes ions to traverse the flight path is substantially constant for ions of the same mass to charge ratio, irrespective of the temperature and the change of time-of-flight of ions along the first segment.

In another aspect of the invention, the invention is directed to a time-of-flight mass spectrometer comprising: at least a first element having a temperature-dependent field parameter that causes a time-of-flight of ions along a flight path to change with a change in temperature, the flight path extending between a first and a second location; and a spacer having a temperature-dependent dimension, the dimension determining a position of a second element, the position influencing the time-of-flight along the flight path of ions within the chamber; wherein the material and size of the spacer are selected such that during operation of the mass spectrometer, the time it takes ions to traverse the flight path is substantially constant for ions of the same mass to charge ratio, irrespective of the temperature and the change of time-of-flight of ions.

A feature of the invention is to provide a solution to the flight time variation with temperature which does not require software correction.

Particular implementations can include one or more of the following features. The first location may be a location where the ions are accelerated into the time-of-flight chamber. The first location may be the location where the ions trigger a timing of the time of flight of the ions to be initiated. The second location may be a location where the ions are detected by the detector. The second location may be a location where the ions trigger the timing of the time of flight of the ions to be terminated. The temperature change may occur in the reflectron or the accelerator. The parameter may be a length or an electric field. The spacer may be coupled to the reflectron element, and may comprise printed circuit board material. The spacer may be formed of a material of high thermal expansion such as aluminium. The spacer may be formed of a material of low thermal expansion.

Unless otherwise defined, all technical and scientific terms used herein have the meaning commonly understood by one of ordinary skill in the art to which this invention belongs. All publications, patent applications, patents, and other references mentioned herein are incorporated by reference in their entirety. In case of conflict, the present specification, including definitions, will control. The disclosed materials, methods, and examples are illustrative only and not intended to be limiting. Skilled artisans will appreciate that methods and materials similar or equivalent to those described herein can be used to practice the invention.

Exemplary embodiments of the invention will now be described and explained in more detail with reference to the embodiments illustrated in the drawings. The features that can be derived from the description and the drawings may be used in other embodiments of the invention either individually or in any desired combination.

DETAILED DESCRIPTION OF THE INVENTION

Figure 1:
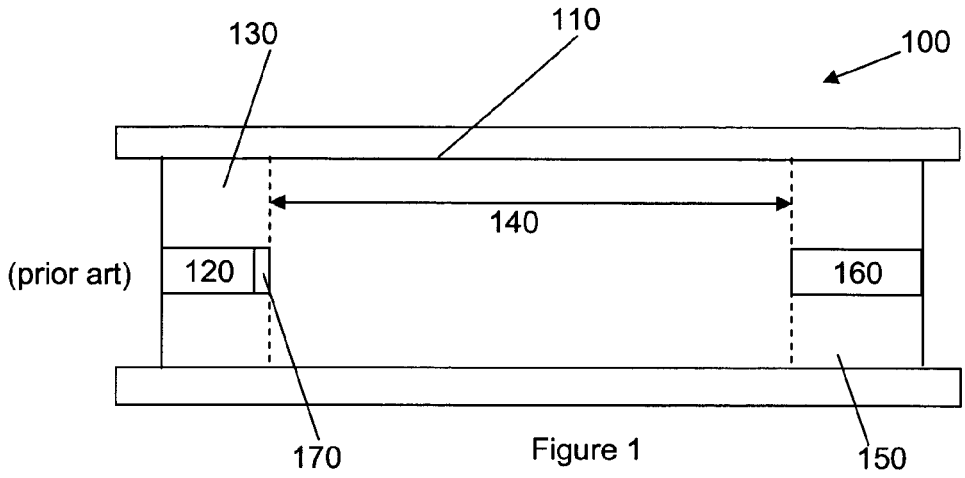
FIG. 1 is a schematic representation of a time-of-flight mass spectrometer according to the prior art.

FIG. 1 shows, in schematic terms, a prior art linear time-of flight mass spectrometer (TOFMS) 100. The ions created for use in a TOFMS can be created in a "pulsed" form, created in a very short time interval (several ns) or can be accumulated for a certain time interval (typically in the $\mu$s range), and then ejected or extracted into the TOFMS by a voltage pulse with a fast rise time. The ions can be formed inside the time-of-flight chamber 110 or formed outside the chamber with the ions then being transported into the time-of-flight chamber 110. The TOF comprises a source of ions 120 such as an electrospray ion source, an electron impact ion sours, a chemical ionization source, an APCI or MALDI source (which generate ions from material received from, for example a liquid chromatograph). An orthogonal drift region as opposed to a linear drift region (as shown) can be employed if so desired.

Ionic particles from the source of ions 120 which may be housed in the source region 130 of the time-of-flight chamber 110, are accelerated by a potential difference 170 into a drift region 140 in time-of-flight chamber 110. As illustrated, the chamber 110 is shown as a single chamber; however in practice, the chamber 110 may contain several sub-chambers (typically in the region of three), each evacuated to a different pressure value by a series of or a hybrid pump. The ions are generally manipulated by a series of rods (multipoles) which reduce interferences from unwanted species and focus the ions so as to reduce the energy spread thereof.

Once in the drift region 140, lighter ions travel faster than heavier ones. The ion beam eventually passes into the detection chamber 150.

The ions arrive at a detector arrangement 160, via an ion flight path, where they are detected. The detector arrangement as used herein is intended to include any means, structure or combination of elements that allows ions to be detected, associated equipment such as voltage supplies, power sources or other such associated electronics, and any apertures or associated coupling means that enable the detector arrangement to be coupled to the time-of-flight mass spectrometer. The time of flight of the ions is in particular determined, and from this a mass spectrum can be built up.

However, if two ions of the same mass are formed at different energies they will traverse the length of the drift region in different times leading to loss of resolution.

Figure 2:
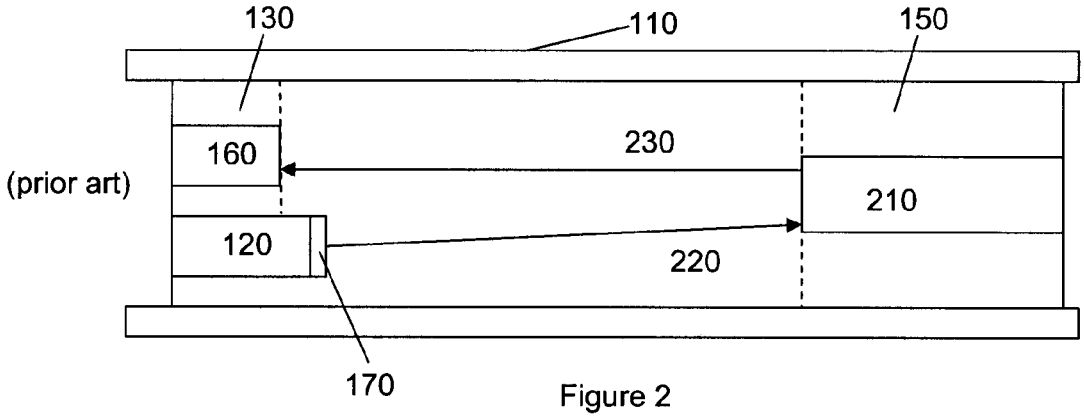
FIG. 2 is a schematic representation of a time-of-flight reflectron-type mass spectrometer according to the prior art.

To improve mass resolution, a reflectron 210 or multiple reflectrons may be employed within the accelerating regions of the ion source and detection chambers 130 and 150 respectively, to effectively double or otherwise multiply the distance travelled by the ion packets, and thus allow for better spatial separation of the ions of differing mass-to-charge ratios within separate packets. This is illustrated in FIG. 2, where it can be seen that the detector arrangement 160 actually resides in the source region 130 of the time-of-flight chamber 110, and the single reflectron 210 resides at least partially in the original detector region 150.

A reflectron is effectively an ion mirror, and may consist of a series of electrostratic fields that collect and redirect the ions in a controlled manner. For ions with the same mass to charge ratio entering a reflectron with its associated electric field, those with higher kinetic energy will penetrate the fields further than those ions with a lower kinetic energy. Therefore ions with a higher velocity ultimately spend more time within the reflectron's fields, and when they eventually turn around, they are travelling behind the lower kinetic energy ions further down the flight path. By adjusting the reflectron potentials, it is possible to ensure that mass to charge ratios that are the same reach the detector at substantially the same time. Typically, ions leaving the reflectron are directed either at an angle towards a detector disposed at the end of the flight tube or back along the flight tube to a detector disposed near the ion source, as illustrated in FIG. 2.

The aggregate time of flight of the ions in the spectrometer is measured by comparing the time between a start indicator and a stop indicator. The start indicator is generally initiated by the time at which the pulse of ions is pushed by the accelerator 170 into the drift region 140. The flight path includes multiple segments, the segment 220 from the accelerator 170 to the reflectron 210, the segment taken within the reflection (not shown), and the segment 230 from the reflectron to the ion detector arrangement 160. The stop indicator comes from the signal that is generated by the ion detector arrangement 160. These indicators provide the output of the TOFMS which displays the data as a histogram of number of counts against the time of flight or may be an analogue signal.

Changes in the temperature of the elements of the structure defining the ion flight path through the time-of-flight mass spectrometer (TOFMS) 100 result in a change in a parameter of the element(s). For example, a temperature may cause the length of the source of ions, 120, at least a portion of the detector arrangement 160, the length of the reflectron 210, the length of the drift region 140, or the length of the any of the rails or housing elements to change in accordance with the thermal expansion coefficients of the element materials. This will change a dimension of at least one segment of the flight path. The change in length can result in an effect on the time of flight of the ions.

If one assumes a positive thermal expansion coefficient, the length of a field free drift space will increase with increasing temperature. As the flight time through a field free drift region 140 is proportional to length, the flight times through the drift region 140 will also increase with increasing temperature. With decreasing temperature the length and therefore the flight times will decrease. Negative thermal expansion coefficients will have the converse effect.

Ion flight path elements defining electric field regions such as lenses, and reflectrons typically consist of discrete electrodes carrying defining voltages separated by insulators. As temperature increases, the length of the field defining electrodes and the insulators will increase by an amount proportional to the thermal expansion coefficients and materials. An increase in these lengths also reduces the electric field strength between the electrode elements. The electric field in such elements may be characterized by one or more temperature-dependent field parameters describing the strength and orientation of the field, which in turn influence the time-of-flight of ions along one or more segments of the flight path. An increase in length and a reduction in field strength result in an increase in ion flight time through the component. The same situation applies in the case of field carrying components not constructed from discrete electrodes. For example, lenses, or reflectrons constructed from resistive material will also increase in length with increasing temperature in accordance with the coefficient of thermal expansion of the resistive material, and the increase in length also produces a reduction in the electric field strength within the component. Ultimately, a change in a parameter of an element generally translates to a change in ion flight time through the element.

In general, for positive thermal expansion coefficients, since the flight time through electric field carrying elements increases with increasing temperature, the total flight time though the system can be kept constant if the field free drift space length is reduced by an appropriate amount with increasing temperature.

Figure 3:
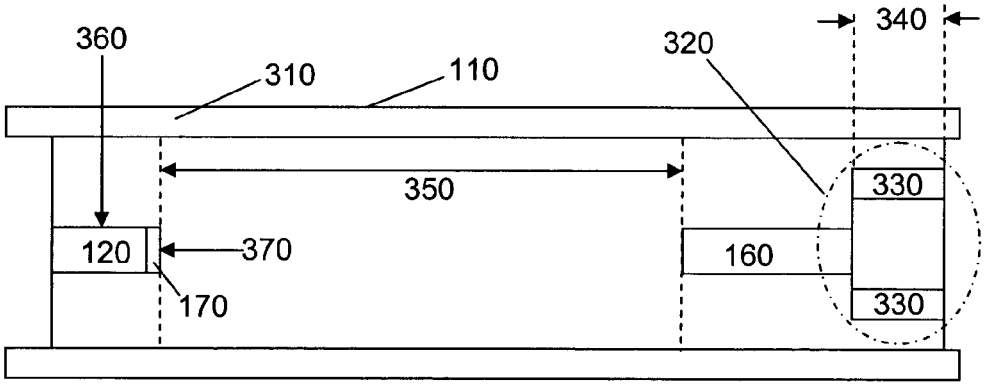
FIG. 3 is a schematic representation of a time-of-flight mass spectrometer according to an aspect of the invention.

FIG. 3 illustrates a first embodiment of the present invention. In this embodiment, elements including the ion optical elements 160 and 210, the detector arrangement and the reflectron respectively, are attached to a frame 310 situated inside the vacuum envelope of the time of flight tube 110, and define a drift region 140 (which may also be an element). The attachment may be facilitated by conventional means such as vented bolts, as typically employed in vacuum technology. The frame in the form of a mounting rail comprises a low thermal expansion material such as invar. In this particular embodiment, the detector mount 320 comprises spacers 330 made from a material with high thermal expansion coefficient such as aluminum. Although only two spacers 330 are illustrated, it will be apparent that any number of or configuration of spacers 330 may be utilized to serve the purpose of the detector mount 320. The length 340 of the spacers 330 is chosen such that the thermal expansion of the spacers 330 changes the length 350 of the drift region 140 between the first location, the source of ions 120, and the second location, the detector arrangement 160, to keep the total or aggregate flight time through the system essentially constant with temperature. That is, the thermal expansion or contraction of the spacers maintains at a constant the time between when a pulse of ions is pushed by the accelerator 170 into the drift region 350 and a signal a signal is generated by the ion detection arrangement 160.

The ion source has a temperature dependent field parameter, that is, as the temperature increases the electrode spacings in the ion source will increase slightly with thermal expansion thereby reducing electric field strengths and increasing flight times through the source region 130.

A similar situation will occur in the ion detector if there are any electric fields traversed by the ions within the detector arrangement 160.

It is also important to consider how the elements such as the source of ions 120, the spacers 330, or the detector arrangement 160 are mounted for accurate calculation of the spacer length required. Typically, the detector arrangement is mounted by use of conventional vented bolts, as employed in vacuum technology systems. Typically, the elements are mounted at one end, facilitating motion at the other end and at points therebetween, or at a point, in a manner that allows motion of the material in question.

If the source of ions 120 is mounted from the rear (as shown in FIG. 3) the expansion in length will be in a direction towards the detector arrangement 160 and will contribute slightly to the required reduction in drift length 350 to keep total flight time constant. If the source of ions 120 is mounted at other points along its length, for example point 360, towards the output end 370 of the source of ions 120, the length expansion of the source of ions 120 will contribute less to the reduction of the length of the drift region 350. Mounting at the output end 370 of the source of ions 120 facilitates the thermal expansion to be in a direction opposite to the detector 160 and there is no contribution to reduction of the length of the drift region 350.

Figure 4:
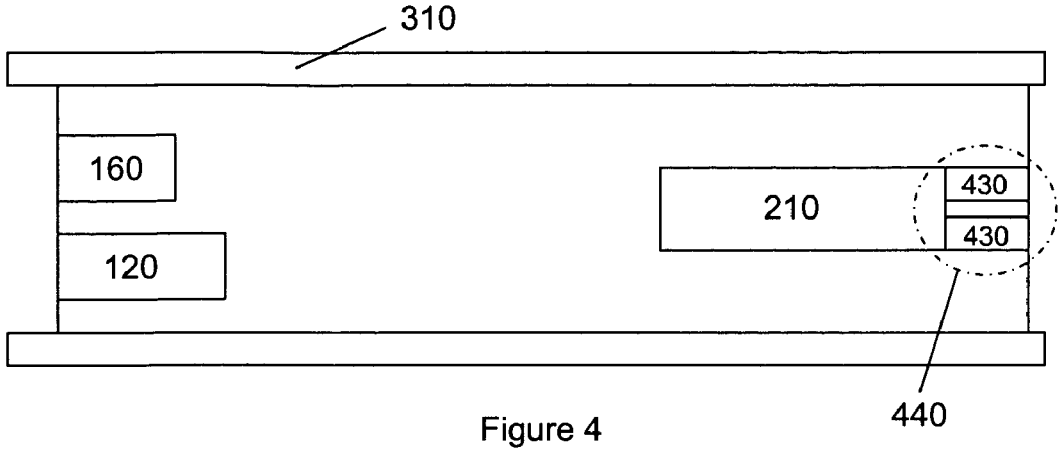
FIG. 4 is a schematic representation of a time-of-flight reflectron-type mass spectrometer according to an aspect of the invention.

FIG. 4 illustrates schematically a reflectron type TOFMS. In this configuration, the reflectron mount 440 comprises spacers 430 of high thermal expansion coefficient. As temperature increases, as with the linear configuration described above, thermal expansion results in a slight decrease in the electric fields within the source of ions 120 (and detector 160 if the ions traverse electric fields). This is also the case within the reflectron 210, and since a significant portion of the flight time is spent within the reflectron 210 the effect is much greater.

As temperature increases the reflectron 210 position is moved towards the source of ions 210 as a result of thermal expansion of the spacers 430, thereby reducing the length of the drift space and hence reducing the flight time in the drift region 140. The reduced flight time in the drift space compensates for the increased flight time in the other ion-optical elements. In this instance, the aggregate flight path 140 is defined from a first location (for example the source of ions) to a second location (for example the detector arrangement). As alluded to previously, the flight path may be regarded as being composed of plural consecutive segments, consisting of the segment from the source of ions 120 to the reflectron 210, the segment within the reflectron 210, and finally the segment from the reflectron 210 to the detector arrangement 160. It should be recognized that the time-of-flight associated with any one segment may vary with temperature (due to, for example, changes in electric fields or physical dimensions caused by a temperature change); however, because of the compensation effect produced by the use of an appropriately sized spacer(s) having a suitable expansion coefficient, the time-of-flight along one or more other segments of the flight path will be adjusted accordingly such that the total time-of-flight along the full flight path is substantially temperature-invariant.

The direction of expansion of the length of the reflectron 210 must be considered in calculation of the appropriate spacer 430 length for the system. If the reflectron is mounted at the rear as illustrated in FIG. 4, the direction of expansion of the reflectron is all towards the source of ions 120, thereby maximizing the contribution of the thermal expansion of the reflectron construction material to reduction of the length 350 of the drift region 140.

Figure 5:
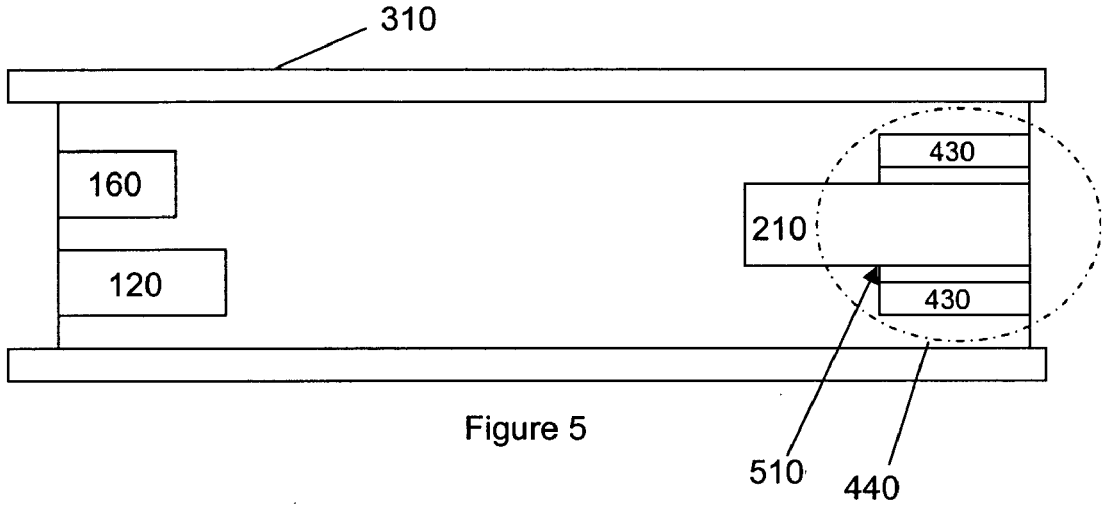
FIG. 5 is a schematic representation of a time-of-flight reflectron-type mass spectrometer according to another aspect of the invention.

It is desirable to maximize the length within the vacuum envelope of the time-of-flight chamber 110 used for the ion flight path to maximise the ion flight times. FIG. 4 illustrates an embodiment in which the reflectron 120 is attached to the spacers 430 at the rear of the reflectron 210, and will reduce the usable length within the vacuum envelope by the length of the spacers. The usable length as used herein is the length that can be used by the ions in creating the ion flight path. It is possible to choose a spacer mounting system such that the usable length is not significantly affected. For example, as illustrated in FIG. 5, the reflectron can be mounted at other points along it length, such as point 510 as illustrated.

Figure 6:
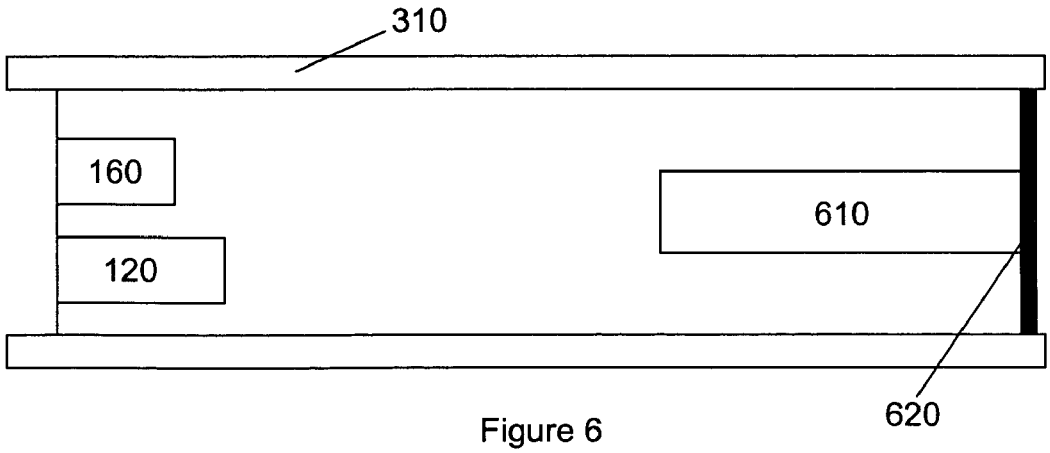
FIG. 6 is a schematic representation of a time-of-flight reflectron-type mass spectrometer according to yet another aspect of the invention.

In a further embodiment of the invention as illustrated in FIG. 6, a longer reflectron 610 is used, and reduction in the length of the drift region 140 as a function of temperature is primarily achieved through thermal expansion of the construction material of the larger reflectron 610. Referring to FIG. 6, the longer reflectron 610 is once again mounted at the rear point and its construction material(s) is free to expand forward as temperature increases, thereby reducing the length of the drift region 140 as a function of temperature.

Parameter sets (reflectron length, reflectron potential, length of the drift region etc.) exist where both energy focusing and temperature compensation are satisfied simultaneously, thereby achieving temperature compensation and high mass resolution. In this case the rear section of the reflectron is not used in the ion flight path, the additional length of the reflectron serving the purpose of provising additional length of material for thermal expansion into the drift region. Essentially, the additional length of the reflectron serves as a "spacer".

In the embodiments described above, the spacer configurations are designed and configured such that they are able to compensate for a change in a parameter of at least one element of the mass spectrometer, the change having been caused by a change in temperature of at least one of the elements. It will be appreciated that in order for these configurations to work effectively, each of the elements should reach their steady state condition at the temperature in question. It will also be appreciated that the time it takes for each of the elements to reach their associated steady state condition may vary from element to element, and this will have to be accounted for during operation of mass spectrometer. The accuracy of measurement that may be achieved by the invention, may only be achievable if the time-of-flight mass spectrometer has been allowed sufficient time to reach its steady state operating conditions or the elements have been sufficiently thermally connected.

The embodiments discussed above are directed towards time-of-flight mass spectrometers, and in particular to maintaining the aggregate ion flight time in the drift region (combined with the ion flight time in the ion optical elements) substantially the same for ions of the same mass to charge ratio. It will be appreciated that the concepts discussed may be applied to other mass spectrometer types where timing is important.

In order to calculate the required spacer length for the spacers discussed above, the length values in the flight time equations need to be expressed as a function of temperature. Hence a length L therefore becomes $L(1+C\Delta T)$, where C is the linear thermal expansion coefficient, and $\Delta T$ is the change in temperature. The length of the field free drift region length is a function of lengths of all other ion-optical elements (as described above) including of course the length of the spacers made from material with a high coefficient of thermal expansion. The expression for total flight time can then be differentiated with respect to $\Delta T$ and equated to zero to find the relationship between the length of the spacer required and all the other voltages and length in the system.

The voltages applied within the system will be those required to give best instrumental performance in terms of energy and space focusing.

Figure 7:
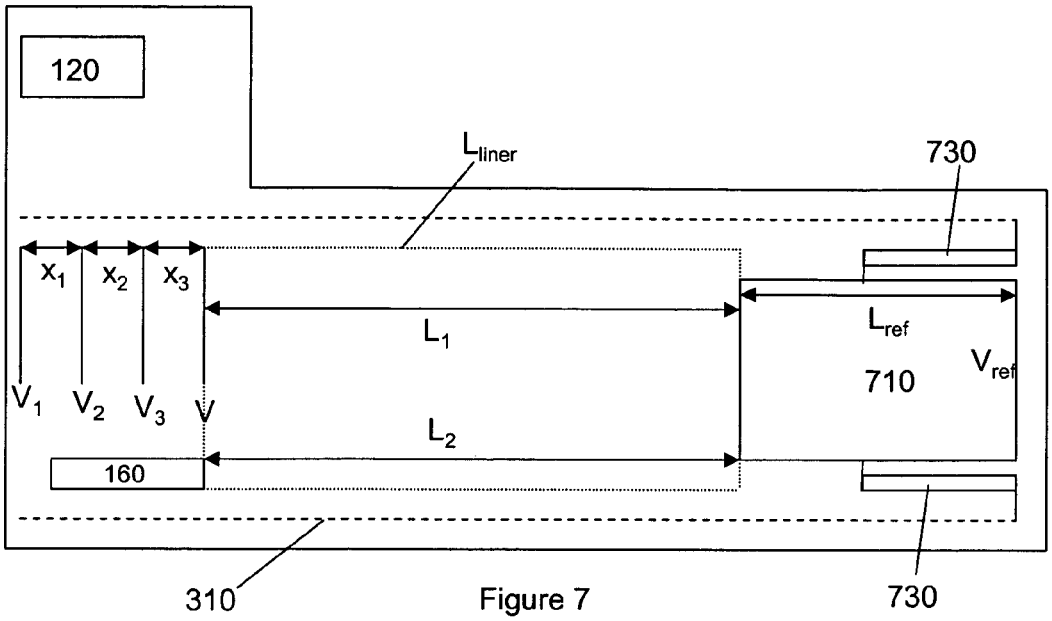
FIG. 7 is a schematic representation of an orthogonal version of the spectrometer shown in FIG. 5, which enables the length of the spacers utilized in the present invention to be calculated.

For example, in another embodiment of the invention illustrated in FIG. 7, where the reflectron, orthogonal acceleration module, and a detector are mounted on an invar support frame, and there is internal liner defining a field free drift region. The reflectron is constructed from printed circuit board (PCB) material on which are printed the electric field defining electrodes. The thermal expansion of the reflectron in this case is determined by the thermal expansion of the PCB material.

The following equations are illustrative of such an orthogonal acceleration TOF construction, and describe how to determine the length of the spacer 730 required for mounting the reflectron 710 from its midpoint:

To calculate the parameter sets for temperature compensation the total flight time expression is differentiated with respect to ΔT (as described above) and equated to zero.

$$T_{120}=C_c.[(x_1/(V_3-V_2)).\sqrt{(V_{acc}-V_2)}+(x_2/(V_2-V_1)).\{\sqrt{(V_{acc}-V_1)}-\sqrt{(V_{acc}-V_2)}\}+(x_3/(V_1-V)).\{\sqrt{(V_{acc}-V)}-\sqrt{(V_{acc}-V_1)}\}]$$

$$L_{730}=\sqrt{(V_{acc}-V)}/(C_s-C_{inv}).[T_{120}+\{2.L_{ref}C/(V_{ref}-V)\}\sqrt{(V_{acc}-V)}+1/(2.\sqrt{(V_{acc}-V)}/(L_{drift}.C_{inv}-L_{ref}C+L_{ref}C_{inv}-(x_1+x_2+x_3).C_c)$$

Where:

The three slope accelerator has voltages $V_3$ (accelerator plate), $V_2$, $V_1$ and V (liner).

Spacings in the accelerator are $x_1$, $x_2$ and $X_3$, where $x_1$ is the gap between the accelerator plate and first plate.

$V_{acc}$=voltage at application of accelerator at the mid point of input beam.

$L_{ref}$=reflectron length.

$L_{drift}$=total field free drift space length, and $L_{drift}=(L_1+L_2)$ $V_{ref}$=voltage on rear of reflectron.

$C_c$=thermal expansion coefficient of spacing material in accelerator.

$C_{inv}$=thermal expansion coefficient of invar.

C=thermal expansion coefficient of PCB material, for a reflectron 710 constructed from printed circuit boards.

$C_s$=thermal expansion coefficient of spacer material.

Figure 8:
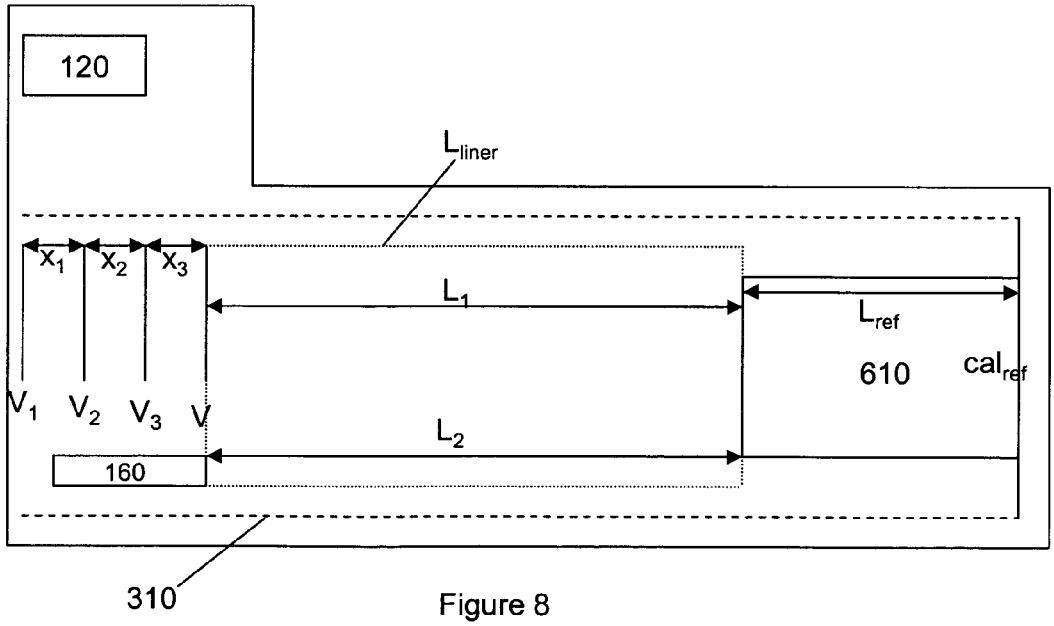
FIG. 8 is a schematic representation of an orthogonal version of the spectrometer shown in FIG. 6, which enables the length of the spacers utilized in the present invention to be calculated.

To calculate the parameter sets for temperature compensation the total flight time expression is differentiated with respect to ΔT (as described above) and equated to zero. For situations such as that illustrated in FIG. 8, where the reflectron itself is used to compensate for the changes in temperature, to calculate the parameter sets for energy compensation the total flight time expression is differentiated with respect to $V_{acc}$ and equated to zero. For conditions of simultaneous energy focusing and temperature compensation the two differentiated expressions are equated. The following equations calculate pairs of values for the total drift length (driftcalc) and voltage applied to the rear of the reflectron (calcref) for the parameters in the orthogonal acceleration TOF of FIG. 8 which gives simultaneous energy focusing and temperature compensation.

$$p_1:=\{x_1C_c/(V_3-V_2)\}.\sqrt{(V_{acc}-V_2)}$$

$$p_2:=\{x_2C_c/(V_2-V_1)\}.[\sqrt{(V_{acc}-V_1)}-\sqrt{(V_{acc}-V_2)}]$$

$$p_3:=\{x_3C_c/(V_1-V)\}.[\sqrt{(V_{acc}-V)}-\sqrt{(V_{acc}-V_1)}]$$

$$p_5:=2.L_{ref}C+2.L_{ref}C_{inv}-(x_1+x_2+x_3).C_c$$

$$t_1:=\{[x_1/2.(V_3-V_2)]\}.[1/\sqrt{(V_{acc}-V_2)}]$$

$$t_2:=\{[x_2/2.(V_2-V_1)]\}.[\{1/\sqrt{(V_{acc}-V_1)}\}-\{1/\sqrt{(V_{acc}-V_2)}\}]$$

$$t_3:=\{[x_3/2.(V_1-V)]\}.[\{1/\sqrt{(V_{acc}-V)}\}-\{1/\sqrt{(V_{acc}-V_1)}\}]$$

$$driftcalc:=\{2.L_{ref}C.\sqrt{(V_{acc}-V)}[t_1+t_2+t_3]-[L_{ref}/\sqrt{(V_{acc}-V)}]\quad[p_1+p_2+p_3]-L_{ref}p_5/2.(V_{acc}-V_1)\}/L_{ref}C.\sqrt{(V_{acc}-V)}.(V_{acc}-V)^{-3/2}/2+(L_{ref}C_{inv})/2.(V_{acc}-V)$$

$$p_4:=[1/2.(V_{acc}-V)].driftcalc.C_{inv}-2L_{ref}C_{inv}-(x_1+x_2+x_3).C_c$$

$$calcref:=(-2.Lref.C.\sqrt{(V_{acc}-V)}/[p_1+p_2+p_3]).+V$$

Those skilled in the art will, of course, be able to combine the features explained on the basis of the various exemplary embodiments and, possibly, will be able to form further exemplary embodiments of the invention.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

The invention claimed is:

1. A time-of-flight mass spectrometer having a time-of-flight chamber and comprising:

at least a first element having a temperature-dependent parameter that causes a time-of-flight of ions along a first segment of a flight path to change with a change in temperature, the flight path extending between a first and a second location; and a spacer having a temperature-dependent dimension, the dimension determining a position of a second element, the position influencing the time-of-flight along a second segment of the flight path of ions within the chamber;

wherein the material and size of the spacer are selected such that during operation of the mass spectrometer, the aggregate time it takes ions to traverse the flight path is substantially constant for ions of the same mass to charge ratio, irrespective of the temperature and the change of time-of-flight of ions along the first segment.

2. The spectrometer of claim 1, wherein:

the time-of-flight of ions along the first segment of the flight path changes such that it increases with a change in temperature and the time-of-flight of ions along the second segment of the flight path is influenced such that it decreases with the change in temperature.

3. The spectrometer as claimed in claim 1, wherein:

the first location is a location where the ions are accelerated into the chamber.

4. The spectrometer as claimed in claim 3, wherein:

the second location is a location where the ions are detected by the ion detector.

5. The spectrometer as claimed in claim 1, wherein:

the first location is a location where the ions trigger a timing of the time of flight of the ions to be initiated.

6. The spectrometer as claimed in claim 5, wherein:

the second location is a location where the ions trigger the timing of the time of flight of the ions to be terminated.

7. The spectrometer as claimed in claim 1, wherein:

the first element is a reflectron, and the temperature-dependent parameter is a length.

8. The spectrometer as claimed in claim 1, wherein:

the first element is a reflectron, and the temperature-dependent parameter is an electric field.

9. The spectrometer as claimed in claim 1, wherein:

the first element is an accelerator, and the temperature-dependent parameter is a length.

10. The spectrometer as claimed in claim 1, wherein:
the first element is an accelerator, and the temperature-dependent parameter is an electric field.

11. The spectrometer as claimed in claim 1, wherein:
the spacer comprises a component of the mass spectrometer.

12. The spectrometer as claimed in claim 11 wherein:
the spacer comprises the ion detector.

13. The time-of-flight mass spectrometer as claimed in claim 11, wherein:
the spacer comprises the reflection element.

14. The spectrometer as claimed in claim 11, wherein:
the spacer comprises the source of ions.

15. The spectrometer as claimed in claim 1, wherein:
the spacer is coupled to the source of ions.

16. The spectrometer as claimed in claim 1, wherein:
the spacer is coupled to the detector.

17. The spectrometer as claimed in claim 1, wherein:
the spacer is coupled to the reflection element.

18. The spectrometer as claimed in claim 11, wherein:
the reflection element comprises printed circuit board material.

19. The spectrometer as claimed in claim 1, wherein:
the spacer is formed of a material of high thermal expansion.

20. The spectrometer as claimed in claim 19, wherein:
the material is aluminium.

21. The spectrometer as claimed in claim 1, wherein:
the spacer is formed of a material of low thermal expansion.

22. A time-of-flight mass spectrometer having a time-of-flight chamber and comprising:

at least a first element having a temperature-dependent field parameter that causes a time-of-flight of ions along a flight path to change with a change in temperature, the flight path extending between a first and a second location; and a spacer having a temperature-dependent dimension, the dimension determining a position of a second element, the position influencing the time-of-flight along the flight path of ions within the chamber;

wherein the material and size of the spacer are selected such that during operation of the mass spectrometer, the time it takes ions to traverse the flight path is substantially constant for ions of the same mass to charge ratio, irrespective of the temperature and the change of time-of-flight of ions.

23. A time-of-flight mass spectrometer comprising:

an ion optical element having a temperature dependent field parameter, including at least a source of ions, and an ion detector; and a spacer which influences an ion drift space length between the source of ions and the ion detector, the spacer configured to expand or contract in length to compensate for the change in flight time caused by a change of temperature of at least one of the ion optical elements within the time-of-flight mass spectrometer which causes a change in field in the ion optical element;

such that during operation of the mass spectrometer, the time it takes ions to travel from the source of ions to the detector is substantially constant for ions of the same mass to charge ratio, irrespective of the change in temperature.

* * * * *